US006000573A

United States Patent [19]

Murphy et al.

[11] Patent Number: 6,000,573

[45] Date of Patent: Dec. 14, 1999

[54] BEVERAGE CONTAINER WITH SELF-CONTAINED DRINKING STRAW

[75] Inventors: Peter F. Murphy, Grosse Pointe, Mich.; Stephen W. Cornell, Naperville, Ill.; Jon Taylor, Chicago, Ill.; David C. Brown, Chicago, Ill.; Doug Brewer, Chicago, Ill.

[73] Assignee: The PopStraw Company, Roseville, Mich.

[21] Appl. No.: 08/992,654

[22] Filed: Dec. 17, 1997

Related U.S. Application Data

[63] Continuation-in-part of application No. 08/856,838, May 15, 1997, Pat. No. 5,819,979.

[51] Int. Cl.[6] ..... A47G 19/22

[52] U.S. Cl. ..... 220/710; 220/706; 220/709; 215/389

[58] Field of Search ..... 220/705–710; 215/387–389

[56] References Cited

U.S. PATENT DOCUMENTS

| | | |
|---|---|---|
| 3,263,855 | 8/1966 | Pugh, Sr. . |
| 3,349,955 | 10/1967 | Cornelius . |
| 3,547,308 | 12/1970 | Gillieon . |
| 3,656,654 | 4/1972 | Brinkley, III. . |
| 3,717,476 | 2/1973 | Harvey . |
| 3,746,197 | 7/1973 | Sather . |
| 3,776,458 | 12/1973 | Chunga . |
| 3,946,895 | 3/1976 | Pugh . |
| 4,078,692 | 3/1978 | Stein . |
| 4,109,817 | 8/1978 | Payne et al. . |
| 4,226,356 | 10/1980 | Lemelson . |
| 4,228,913 | 10/1980 | Mack et al. . |
| 4,305,521 | 12/1981 | Komatsuta et al. . |
| 4,356,927 | 11/1982 | Cooper et al. . |
| 4,424,913 | 1/1984 | Ko . |
| 4,462,503 | 7/1984 | DiRaffaele et al. . |
| 4,537,324 | 8/1985 | Wang . |
| 4,561,557 | 12/1985 | Park et al. . |
| 4,582,213 | 4/1986 | Park et al. . |
| 4,690,294 | 9/1987 | Jones . |

(List continued on next page.)

FOREIGN PATENT DOCUMENTS

| | | |
|---|---|---|
| 2590237 | 11/1985 | France . |
| 2615487 | 11/1988 | France . |
| 2627753 | 9/1989 | France . |
| 2650488 A1 | 5/1978 | Germany . |
| 3-98877 | 4/1991 | Japan . |
| 4-44955 | 2/1992 | Japan . |
| 4-72149 | 3/1992 | Japan . |
| WO 85/04850 | 11/1985 | WIPO . |

*Primary Examiner*—Stephen Castellano
*Attorney, Agent, or Firm*—Harness, Dickey & Pierce, P.L.C.

[57] ABSTRACT

A beverage container has a straw-dispensing mechanism that is disposed within the container to bring the straw into alignment with the orifice in the top of the container. When the orifice is opened, the straw elevates through the orifice to become accessible to the user. In one embodiment, the straw is attached to a buoyant member which urges the straw into contact with a contoured surface on the can lid. In a second embodiment, the straw engages a floating member which is urged against the lid of the container. In a third embodiment, a buoyant member is integrally formed with the straw and is disposed orthogonally within the body of the can. In a fourth embodiment, the floating member includes a surface treated for facilitating the nucleation of $CO_2$ thereon. In a fifth embodiment, the floating member is provided with a skirt for entrapping a head space gas bubble under the floating member. In a sixth embodiment, the floating member reacts to a change in pressure to disengage from the container wall. In a seventh embodiment, a latch is provided on the floating member for releasing the floating member from engagement with the container walls. In an eighth embodiment, the floating member is provided with a threaded aperture for releasably engaging a threaded member on the bottom of the container. In a ninth embodiment, a straw positioning member is provided with an inertia latch which opens to increase the diameter of the straw positioning member such that it engages the container wall.

14 Claims, 11 Drawing Sheets

U.S. PATENT DOCUMENTS

| | | | |
|---|---|---|---|
| 4,709,829 | 12/1987 | Johnson et al. . | |
| 4,712,702 | 12/1987 | Ayabe et al. . | |
| 4,728,001 | 3/1988 | Serba . | |
| 4,826,034 | 5/1989 | Forbes . | |
| 4,842,157 | 6/1989 | Stone-Parker et al. . | |
| 4,877,148 | 10/1989 | Larson et al. . | |
| 4,892,187 | 1/1990 | Stein . | |
| 4,923,083 | 5/1990 | Forbes . | |
| 4,923,084 | 5/1990 | Forbes . | |
| 4,925,040 | 5/1990 | Wang . | |
| 4,930,652 | 6/1990 | Murphy et al. | 215/388 |
| 4,948,008 | 8/1990 | Wu et al. . | |
| 5,054,639 | 10/1991 | Ahn . | |
| 5,080,247 | 1/1992 | Murphy et al. | 215/389 |
| 5,160,058 | 11/1992 | Ahn . | |
| 5,172,827 | 12/1992 | Chang et al. . | |
| 5,174,469 | 12/1992 | Policapelli | 220/710 |
| 5,244,112 | 9/1993 | Murphy et al. | 215/389 |
| 5,253,779 | 10/1993 | Lee . | |
| 5,547,103 | 8/1996 | Murphy et al. | 220/709 |
| 5,819,972 | 10/1998 | Puente Pubill | 220/705 |
| 5,819,979 | 10/1998 | Murphy et al. | 220/706 |

BEVERAGE CONTAINER WITH SELF-CONTAINED DRINKING STRAW

CROSS-REFERENCE TO RELATED APPLICATIONS

This application is a continuation-in-part of U.S. application Ser. No. 08/856,838, filed May 15, 1997 now U.S. Pat. No. 5,819,979.

FIELD OF THE INVENTION

The present invention relates to beverage containers having a self-contained straw. More particularly, the present invention relates to beverage containers having a self-contained straw which becomes accessible to the user when the beverage container is opened.

BACKGROUND AND SUMMARY OF THE INVENTION

Currently, beverage containers are manufactured, filled, and sealed in a high-speed automated process. This process includes manufacturing a separate body for containing the fluid or beverage and a separate lid for sealing the open end of the body. During manufacture of the filled beverage container, a manufacturing operation known as "seaming" places the lid on a filled can body and seals its perimeter. At present, known seaming operations pass the lids horizontally across the top of the filled can bodies at a vertical distance of only a few millimeters above the top edge of the can body. Once positioned on top of the can body, the seaming operation seals the fluid or beverage within the beverage container. This seaming operation involves the use of very expensive high-speed machinery and tooling or retooling this high-speed machinery to accommodate a self-contained drinking straw is not a practical solution.

Various designs have been proposed in the prior art for placing a straw within a beverage can that becomes accessible to the user when the tab in the lid of the can is deflected into the interior to open the can. The vast majority of these designs can be categorized into two groups. The first group comprises designs wherein the straw is installed within the can so as to be prealigned with the tab opening. Thus, when the tab is opened, access to the straw is presented. The practical disadvantage with this approach is that the bodies and lids of the cans are randomly oriented during the present day seaming operations. Consequently, any design that requires prealignment of the straw with the opening in the lid is not readily adaptable to the existing high-speed filling equipment.

The second group of designs generally involves the mounting or attachment in some manner of the straw to the underside of the lid such that when the can is opened, the end of the straw is drawn through or otherwise made accessible through the opening. These designs are also not readily adaptable to the existing high-speed filling canning equipment due to the fact, as noted above, the commercial filling processes pass the lid within a few millimeters of the top of the can during the high-speed seaming operation. Consequently, any structure that is attached or otherwise appended to the underside of the lid will disrupt the seaming process and thus require expensive retooling of the existing high-speed machinery.

A different approach for this concept is disclosed in U.S. Pat. No. 5,547,103 which is assigned to the assignee of the present invention. This patent discloses various embodiments of a beverage container having a straw-dispensing mechanism that relies upon user manipulation of the container and the forces of gravity to bring the straw into alignment with the opening in the lid. The user merely tilts the beverage container, preferably prior to opening, to cause the mechanism within the container to bring the straw into general alignment with the tab. Once the container is opened, further minor manipulation or tilting of the container may be necessary to complete the alignment of the straw with the open orifice in the lid.

Yet another approach for this concept is disclosed in U.S. Pat. Nos. 5,244,112; 5,080,247 and 4,930,652 which are also assigned to the assignee of the present invention. These patents describe various embodiments of a straw-dispensing mechanism that is disposed within the body of the container which operate to rotate the straw into alignment beneath the open orifice of a beverage container. In particular, these designs respond to the inward deflection of the closure tab into the body of the container to actuate or drive a rotating mechanism which aligns the straw with the open orifice. While these designs remain technologically and commercially viable, the continued development of straw-dispensing mechanisms is directed to simpler and lower cost mechanisms which can be relied upon to consistently align the drinking straw with the open orifice in the beverage can once the orifice in the beverage can has been opened. Also, continued development is directed to alternative mechanisms for temporarily securing straw dispensing mechanisms within the container so as to not interfere with the filling and seaming processes.

In this regard, the present invention discloses a beverage container having a straw-dispensing mechanism which includes a contoured or shaped cam surface which operates to cause rotation of the drinking straw to align the drinking straw with the orifice. A first embodiment of the present invention employs a float which supports and positions the drinking straw at a distance radially which is equal to the radial position of the orifice in the can lid. A contoured or cam surface located on the interior surface of the lid of the can guides the drinking straw into alignment with the orifice in the can.

A second embodiment employs a float which supports and positions the drinking straw at a distance radially which is equal to the radial position of the orifice in the can lid. A contoured or cam surface located on the upper surface of the float reacts with the inward deflected tab upon opening of the beverage can to rotate the drinking straw to a position in alignment with the now open orifice.

A third embodiment includes a buoyant member integrally formed with the straw. The buoyant member and lower end of the straw are disposed generally horizontally within the beverage container while the remainder of the straw is generally vertical. The buoyant member provides a convenient surface for temporarily securing the straw to the bottom of the container. When this bond is broken, the buoyant member rotates to a generally vertical orientation aligned with the remainder of the straw to urge the straw into alignment with the orifice in the can.

A fourth embodiment includes a floating member having an underside treated for facilitating the nucleation of $CO_2$ bubbles. The underside is coated with a soluble material so as to not disrupt the filling and seaming processes. After the coating dissolves and the container is opened, $CO_2$ bubbles released from the fluid within the container adhere to the underside of the floating member to further urge the floating member against the lid of the container.

A fifth embodiment includes a floating member having a circumferential skirt formed thereabout. After the filling and seaming processes the container is inverted and then returned to its upright orientation. Thereafter, the headspace air gap normally residing adjacent the container lid is trapped under the floating member by the skirt. The trapped headspace further urges the floating member into contact with the lid of the container.

In a sixth embodiment the floating member is held to a fixed location within the container during the filling and seaming processes by a pair of leg assemblies. When the pressure within the container exceeds a given threshold, an outwardly domed lower surface of the floating member collapses inwardly to change the angle of the leg assemblies such that they disengage from the container wall. Thereafter, the floating member is free to migrate towards the lid of the container under it own buoyancy.

In a seventh embodiment an arm is coupled to the floating member by way of a living hinge. The arm is held in a closed mode against the bias of the living hinge by a latch. In the closed mode, the living hinge and latch engage the container wall to hold the floating member in a fixed location during the filling and seaming processes. Thereafter, a sudden blow to the container causes the latch to release the arm. The arm rotates under the bias of the living hinge pushing against the bottom of the container and urging the floating member towards the lid. Simultaneously, the latch folds inwardly under its own bias and disengages itself and the living hinge from the container wall. Thereafter, the floating member is free to float towards the lid of the container.

An eighth embodiment includes a floating member having a threaded aperture formed therein. The threaded aperture removably engages a threaded member upwardly projecting from a base member adjacent the bottom of the container. The threaded engagement secures the floating member to a fixed location during the filling and seaming processes. Thereafter, rotation of the container causes the fluid contained therein to interfere with the floating member in a desired manner to drive it about the threaded member. Upon sufficient rotation, the threaded aperture backs off the threaded member such that the floating member disengages from the base and is free to migrate towards the lid of the container.

A ninth embodiment includes a straw positioning member having a ring-like configuration for holding the straw in a fixed location so as to not interfere with the filing and seaming processes. The straw positioning member includes an inertia latch operable for changing the straw positioning member from a closed mode to an open mode. In a closed mode, the straw positioning member has diameter less than that of the container. In an open mode, the straw positioning member is biased radially outwardly so as to engage the container wall.

Thus, it is an object of the present invention to provide a beverage container with a self-contained straw-dispensing mechanism that is compatible for manufacture with existing filling equipment.

In addition, it is an object of the present invention to provide such a beverage container with a self-contained straw-dispensing mechanism that is simple in design, utilizes a minimum of material, is inexpensive to manufacture, and requires relatively inexpensive equipment to assemble and insert into the beverage containers.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENTS

Figure 1:
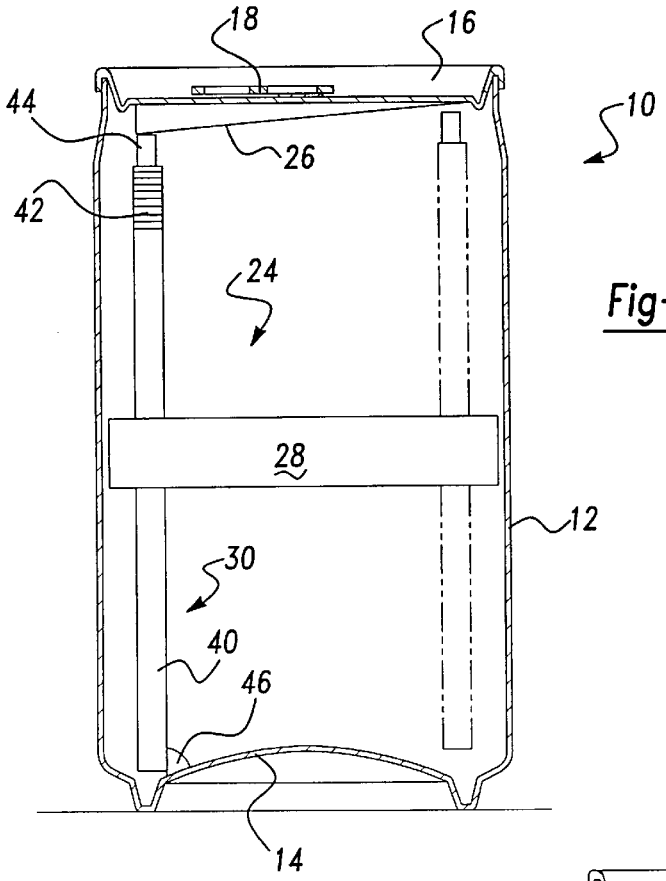
FIG. 1 is a vertical sectional view of a beverage can containing a straw-dispensing mechanism according to a first embodiment of the present invention.
Figure 2:
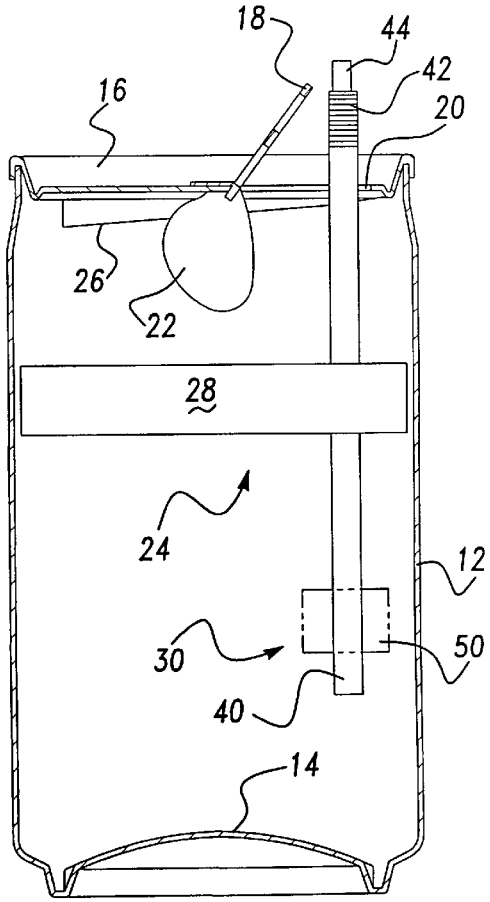
FIG. 2 is a vertical sectional view of the beverage can shown in FIG. 1 illustrating the straw ascending through the orifice in the lid of the can.
Figure 3:
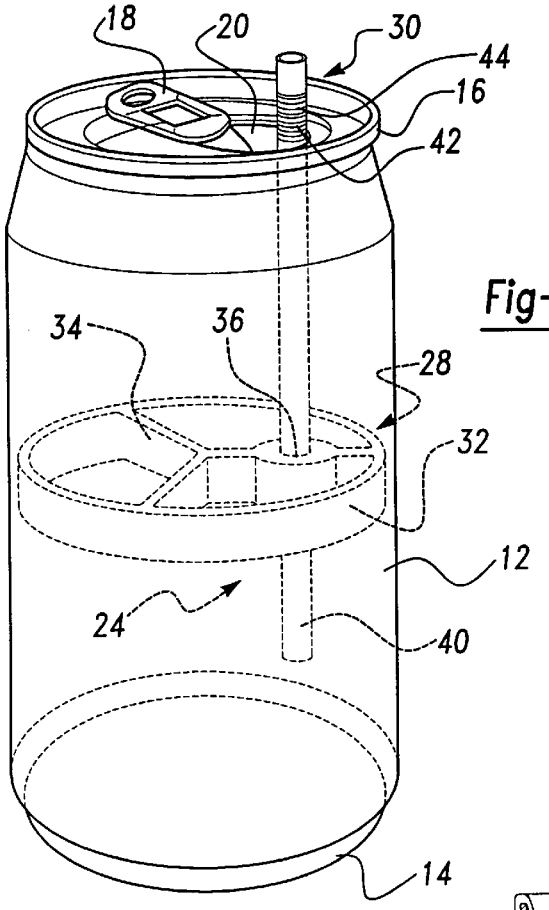
FIG. 3 is a front perspective view of the beverage can shown in FIGS. 1 and 2 illustrating the straw in the extended position.

Referring now to the drawings in which like reference numerals designate like or corresponding parts throughout the several views, there is shown in FIGS. 1–3 a beverage can having a straw dispensing mechanism in accordance with the present invention which is designated generally by reference numeral 10. Beverage can 10 comprises an aluminum, steel or plastic container having a cylindrical body 12 with a closed bottom 14 and an upper lid 16. Lid 16 is joined to body 12 using a seaming operation as is well known in the art. Lid 16 includes an actuating member or lever ring 18 pivotally secured to lid 16. Lever ring 18 is adapted when actuated to open an orifice 20 in lid 16 by deflecting a closure tab 22 into the interior of beverage can 10. Closure tab 22 is formed by score lines in lid 16 which enable a controlled portion of closure tab 22 to break free from lid 16 when lever ring 18 is actuated against tab 22 by an individual. As the user lifts one end of ring 18 to its maximum extent, the opposite end pushes against closure tab 22. Alternatively, the tab could be designed to brake free when depressed by the user's finger or by the use of a portable tool. In these types of closure tabs, lever ring 18 may be omitted. Closure tab 22 is typically designed via the score lines to deflect downwardly and toward one side of orifice 20 to fully open orifice 20 and facilitate the free flow of liquid from beverage can 10 through orifice 20.

Beverage can 10 further comprises a straw dispensing mechanism 24 which is comprised of a contoured or cam surface 26 located on the inside of lid 16, a buoyant member or float 28 and a drinking straw 30. Contoured or cam surface 26 is formed by lid 16 and is angled towards orifice 20 in order to guide straw 30 into alignment with orifice 20. Surface 26 may be formed into lid 16 with the reverse of the contoured surface being located on the top surface of lid 16 if desired or contoured surface 26 may be formed by a separate insert placed within beverage can 10.

Buoyant member 28 is manufactured from a material which will float within the liquid contained inside beverage can 10 and thus provide sufficient buoyant force (when liquid is present in beverage can 10) to cause straw 30 to be urged against contoured surface 26 and eventually to ascend through orifice 20 in can lid 16 when straw 30 is in alignment with orifice 20.

Buoyant member 28 is a circular member which includes an outer ring 32, a plurality of ribs 34 and a straw aperture 36. Outer ring 32 is an annular member which has an outer surface which is sized slightly smaller than the internal diameter of can body 12. Thus, outer ring 32 is free to move axially within beverage can 10. The height of outer ring 32 is sized to work in conjunction with straw 30 to limit the tilting of outer ring 32 in order to maintain straw 30 in a generally vertical position as shown in the drawings. The plurality of ribs 34 extend inwardly from outer ring 32 to meet at the center defined by outer ring 32. Ribs 34 provide rigidity to outer ring 32 and while three ribs 34 are shown in FIGS. 1–3, any suitable number of ribs may be utilized. During filling of beverage can 10, the plurality of ribs 34 permit filling of the volume of beverage can 10 located below buoyant member 28. One of the plurality of ribs 34 forms straw aperture 36. The radial positioning of aperture 36 along rib 34 positions aperture 36 in direct alignment with orifice 20 when aperture 36 is circumferentially aligned with orifice 20.

Drinking straw 30 includes a lower tubular portion 40, a pull-out flexible convoluted section 42 and an upper tubular portion 44. Lower tubular portion 40 of drinking straw 30 extends through aperture 36 in buoyant member 28. Aperture 36 frictionally receives straw 30 such that vertical movement of buoyant member 28 within beverage can 10 causes vertical movement of straw 30. Alternatively, a buoyant member 50 (shown in phantom in FIG. 2) may be attached to straw 30 or straw 30 can be manufactured from a buoyant material to provide the necessary buoyancy to straw 30.

FIG. 1 illustrates beverage can 10 and straw dispensing mechanism 24 immediately after the filling and seaming operation have been performed. Drinking straw 30 extends from bottom 14 of can body 12 vertically upward through aperture 36 of buoyant member 28 towards lid 16. The circumferential positioning of straw 30 in relation to orifice 20 occurs randomly due to the filling and seaming processes for beverage can 10. To prevent buoyant member 28 from elevating straw 30 during the can filling and seaming processes, and thus possibly interfering with these processes, a small amount of soluble adhesive 46 such as glucose or thixotropic gel, is preferably applied to temporarily bond straw 30 to can body 12 or closed bottom 14. Accordingly, after the filling and seaming processes are complete, adhesive 46 will gradually dissolve and thereby enable buoyant member 28 and straw 30 to float freely upward until straw 30 contacts contoured surface 26 on the underside of lid 16. During the subsequent handling of beverage can 10, straw 30 will react with contoured surface 26 to rotate buoyant member 28 and straw 30 until it is aligned with orifice 20 as shown in phantom in FIG. 1. The reaction between straw 30 and contoured surface 26 occurs due to the buoyant force exerted on straw 30 by buoyant member 28. Straw 30 will have a tendency to align with orifice 20 due to the ramping of contoured surface 26 towards orifice 20 regardless of the direction of rotation of buoyant member 28.

FIG. 2 illustrates beverage can 10 and straw dispensing mechanism 24 after lever ring 18 has pushed closure tab 22 into the interior of beverage can 10 to open orifice 20. Depending on the circumferential position of straw 30, in relation to orifice 20, the opening of orifice 20 may or may not result in contact between closure tab 22 and straw 30. Any contact between closure tab 22 and straw 30 will cause rotation of buoyant member 28 and straw 30 to slightly misalign straw 30 with orifice 20. This misalignment will be corrected once closure tab 22 is completely deflected to fully open orifice 20 by the interaction between straw 30 and contoured surface 26 as detailed above. Once straw 30 is aligned with orifice 20, the buoyant force on buoyant member 28 will push straw 30 upward through orifice 20 to provide accessibility to straw 30 for the user of beverage can 10.

At this point, the user may elect to commence drinking through straw 30 or withdraw straw 30 further through orifice 20 in lid 16. Buoyant member 28 is formed with sufficient rigidity and the frictional interface between straw 30 and aperture 36 of buoyant member 28 is sufficiently low to permit straw 30 to be pulled upward through buoyant member 28 as buoyant member 28 is held against the underside of lid 16. Convoluted section 42 can be extended regardless of whether or not straw 30 extends through aperture 36, to allow the user to extend the length of straw 30 so that the other end of straw 30 reached fully to the bottom 14 of beverage can 10 while upper portion 44 remains accessible through orifice 20.

Figure 3A:
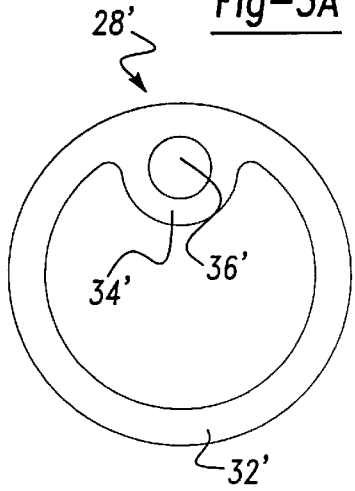
FIG. 3A is a plan view of a buoyant member in accordance with another embodiment of the present invention.

FIG. 3A illustrates a buoyant member 28' in accordance with another embodiment of the present invention. Buoyant member 28' comprises an outer ring 32', a radially inwardly disposed embossment 34' and a straw aperture 36'. Buoyant member 28' is a direct replacement for buoyant member 28.

Figure 4:
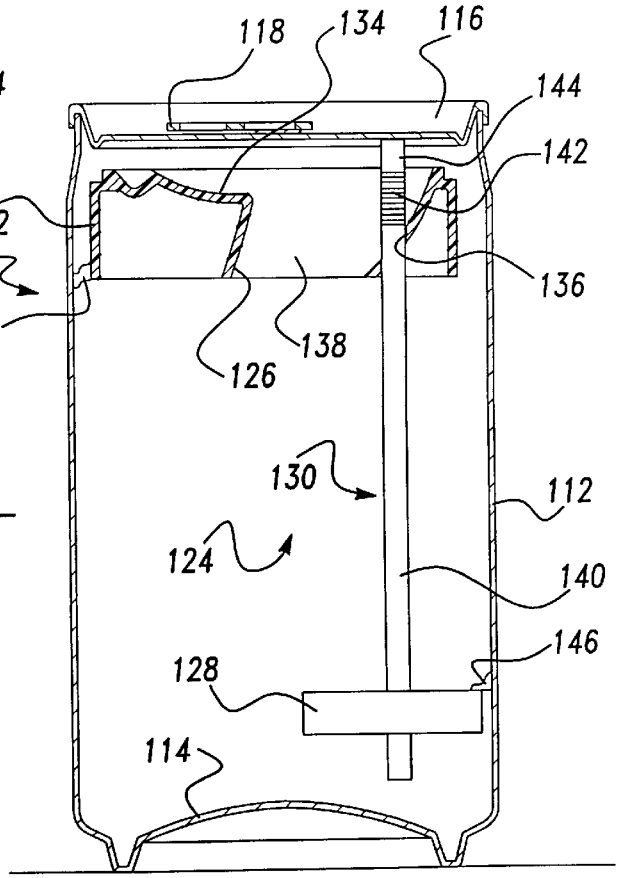
FIG. 4 is a vertical sectional view of a beverage can containing a straw-dispensing mechanism according to a second embodiment of the present invention.
Figure 5:
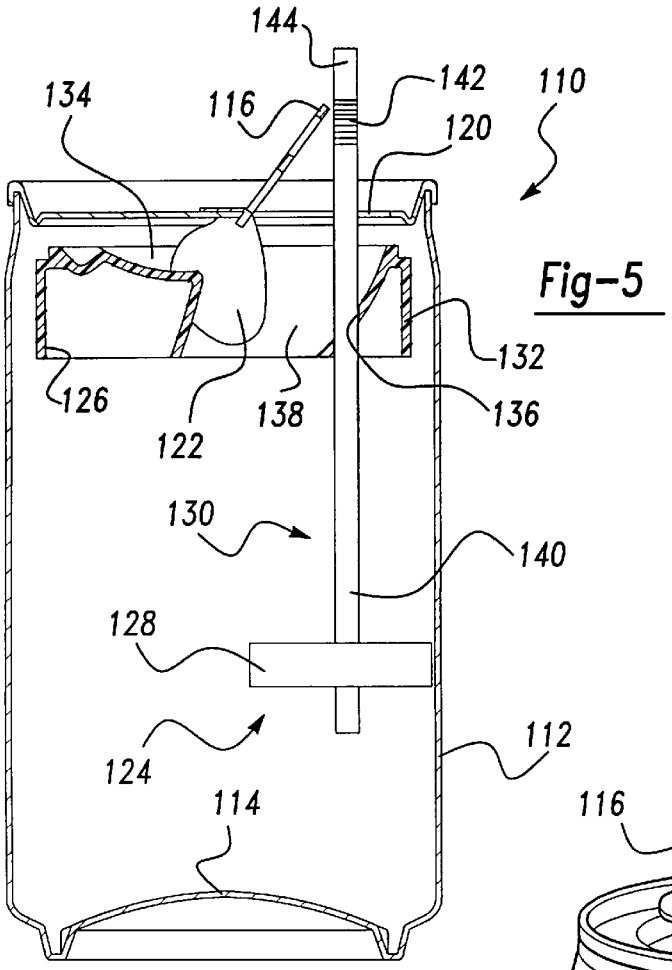
FIG. 5 is a vertical sectional view of the beverage can as shown in FIG. 4 illustrating the straw ascending through the orifice in the lid of the can.
Figure 6:
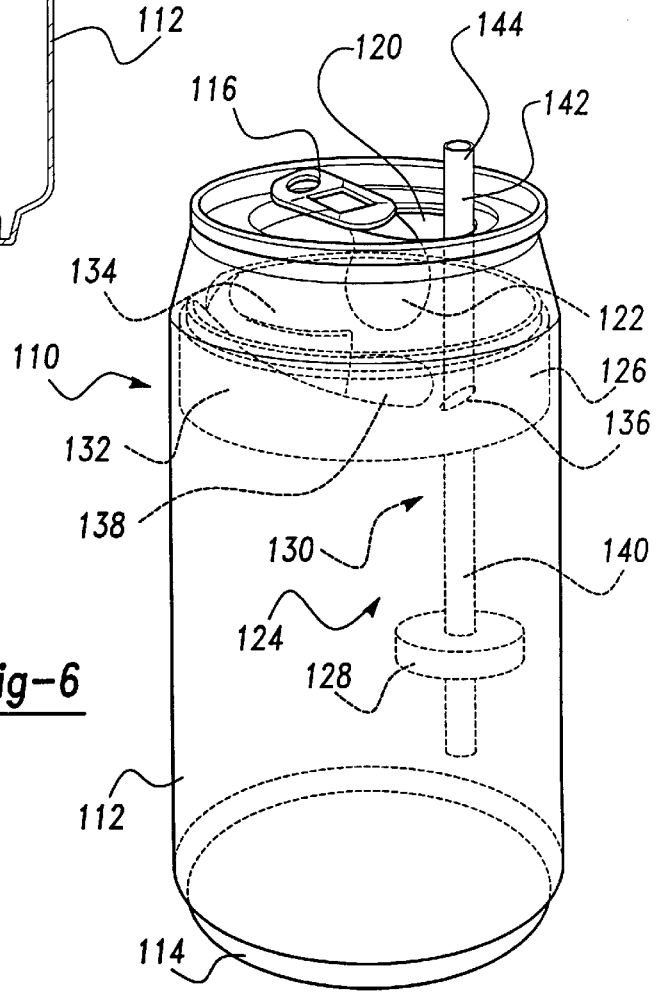
FIG. 6 is a front perspective view of the beverage can shown in FIGS. 4 and 5.

Referring now to FIGS. 4 through 6 there is shown a beverage can having a straw dispensing mechanism in accordance with another embodiment of the present invention which is designated generally by reference numeral 110. Beverage can 110 comprises an aluminum, steel or plastic container having a cylindrical body 112 with a closed bottom 114 and an upper lid 116. Lid 116 is joined to body 112 using a seaming process as is well known in the art. Lid 116 includes an actuating member or lever ring 118 pivotally secured to lid 116. Lever ring 118 is adapted when actuated to open an orifice 120 in lid 116 by deflecting a closure tab 122 into the interior of beverage can 110. Closure tab 122 is formed by score lines in lid 116 which enable a controlled portion of closure tab 122 to break free from lid 116 when lever ring 118 is actuated against tab 122 by a user. As the user lifts one end of ring 118, the opposite end pushes against closure tab 122. Alternatively, the tab could be designed to break free when depressed by the user's finger or by the use of a portable tool. In these types of closure tabs, lever ring 18 may be omitted. Closure tab 122 is typically designed via the score lines to deflect downwardly and towards one side of orifice 120 to fully open orifice 120 and facilitate the free flow of liquid from beverage can 110 through orifice 120.

Beverage can 110 further comprises a straw dispensing mechanism 124 which is comprised of a floating member 126, a buoyant member 128 and a drinking straw 130. Floating member 126 defines an outer cylindrical surface 132, a contoured or cam surface 134 and a straw aperture 136.

Floating member 126 is manufactured from a material which will float within the liquid contained inside beverage can 110 and thus will position itself adjacent to lid 116 in a filled beverage can 110. Outer cylindrical surface 132 of floating member 126 is sized slightly smaller than the internal diameter of can body 112. Thus, floating member 126 is free to move axially within beverage can 110 and will be urged against lid 116 due to the buoyant force acting on floating member 126. The height of surface 132 is chosen to work in conjunction with straw 130 to limit the tilting of floating member 126 in order to maintain straw 130 in a generally vertical position as shown in the drawings. Aperture 136 extends vertically through floating member 126. The radial positioning of aperture 136 positions aperture 136 in direct vertical alignment with orifice 120 when aperture 136 is circumferentially aligned with orifice 120. A centrally located aperture 138 allows for the filling of the volume of beverage can 110 located below floating member 126. Alternatively, additional passages through floating member 126 or the clearance between floating member 126 and the interior of can body 112 may be used to facilitate the filling of beverage can 110.

Drinking straw 130 includes a lower tubular portion 140, a pull-out flexible convoluted section 142 and an upper tubular portion 144. Lower tubular portion 140 of drinking straw 130 extends through aperture 136 in floating member 126. Aperture 136 is slightly larger than lower tubular portion 140 and thus slidingly receives lower tubular portion 140. Thus, floating member 126 is free to move vertically within beverage can 110 with respect to straw 130. Buoyant member 128 is attached to the lower end of lower tubular portion 140 to urge straw 130 in an upward direction. The diameter of buoyant member 128 is chosen such that when the outer edge of buoyant member 128 is in contact with the inside wall of can body 112, straw 130 is positioned generally vertically within beverage can 110. Thus, buoyant member 128 will act as a torque arm to reduce the amount of tilting of floating member 126 during the opening of beverage can 110 as will be described later herein.

FIG. 4 illustrates beverage can 110 and straw dispensing mechanism 124 immediately after the filling and seaming operation have been performed. Drinking straw 130 extends from bottom 114 of can body 112 vertically upward through aperture 136 of floating member 126 towards lid 116. The circumferential positioning of straw 130 in relation to orifice 120 (FIG. 5) occurs randomly due to the filling and seaming processes for beverage can 110. To prevent floating member 126, buoyant member 128 and straw 30 from elevating during the can filling and seaming processes, and thus possibly interfering with these processes, a small amount of soluble adhesive 146, such as glucose or thixotropic gel, is preferably applied to temporarily bond floating member 126 and buoyant member 128 to can body 112. Another option would be to locate floating member 126 toward the bottom 114 of can body 112. Floating member 126 would then retain both buoyant member 128 and straw 130 within beverage container 110. In addition, the location of floating member 126 toward the bottom of can body 112 would minimize the volume of beverage can 110 located below floating member 126 to simplify the filling operation. Accordingly, after the filling and seaming processes are complete, adhesive 146 will gradually dissolve and thereby enable floating member 126 to float upwardly to be urged against lid 116 and enable buoyant member 128 and straw 130 to float freely upward until straw 130 contacts lid 116 as shown in FIG. 4. The circumferential positioning of straw 130 in relation to orifice 120 occurs randomly due to both the filling and seaming processes and any rotation which may occur as floating member 126 moves upward from its retained position during filling to its position shown in FIG. 4.

FIG. 5 illustrates beverage can 110 and straw dispensing mechanism 124 after lever ring 118 has pushed closure tab 122 into the interior of beverage can 110 to open orifice 120. The deflection of closure tab 122 from its closed (generally horizontal) position as shown in FIG. 4 to its open (generally vertical) position as shown in FIG. 5 results in engagement between closure tab 122 and floating member 126 which imparts rotational movement to floating member 126, buoyant member 128 and straw 130. Floating member 126 will rotate until straw 130 is aligned with open orifice 120. When straw 130 is aligned with orifice 120, buoyant member 128 will push straw 130 upward through orifice 120 to provide accessibility to straw 130 by the user of beverage can 110.

At this point, the user may elect to commence drinking through straw 130 or withdraw straw 130 further from its orifice 120 in lid 116. Buoyant member 128 is formed with sufficient flexibility and the interface between straw 130 and buoyant member 128 will release is sufficiently strong to retain buoyant member 128 on straw 130 when straw 130 is pulled upward causing straw 130 and buoyant member 128 to pass through floating member 126. Alternatively, the buoyant member can be designed to separate from straw 130. This would require the size of he float to be such that it would not pass through orifice 120 or aperture 138. Convoluted section 142 can be extended regardless of whether or not straw 130 extends through aperture 136, to allow the user to reach fully to bottom 114 of beverage can 110.

Figure 7:
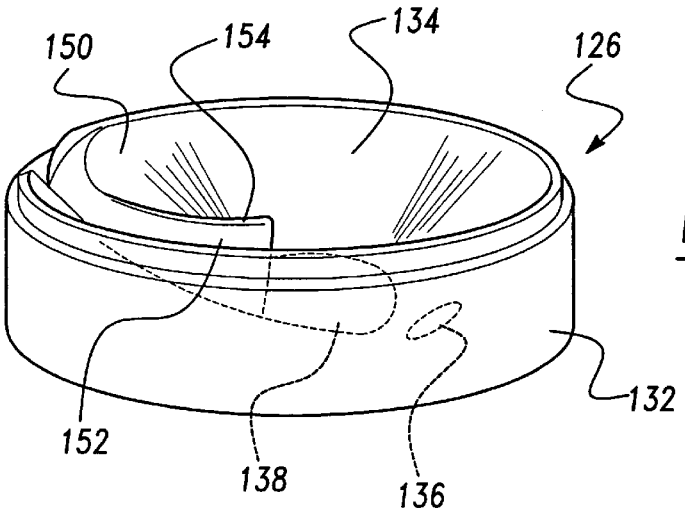
FIG. 7 is a perspective view of the floating disk shown in FIGS. 4–6.
Figure 8:
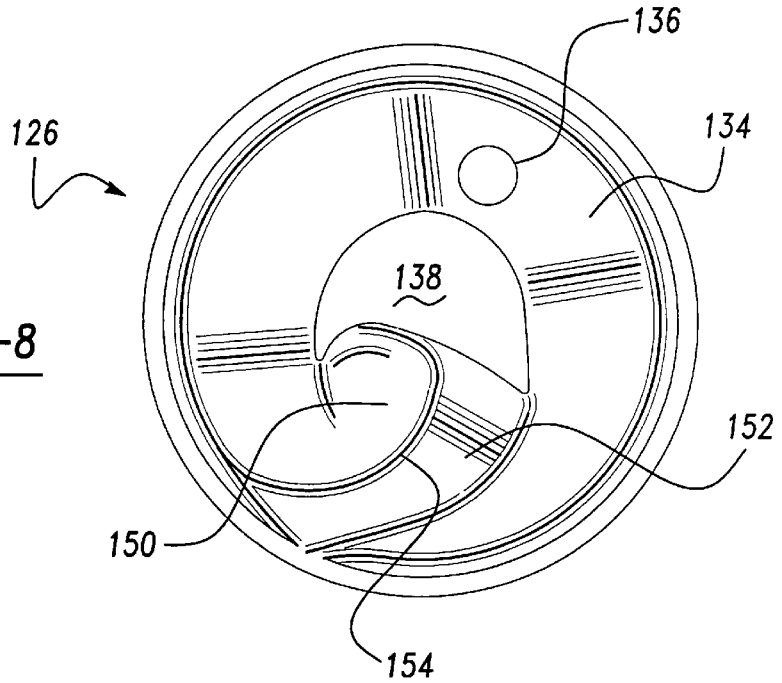
FIG. 8 is a plan view of the floating disk shown in FIG. 7.
Figure 9:
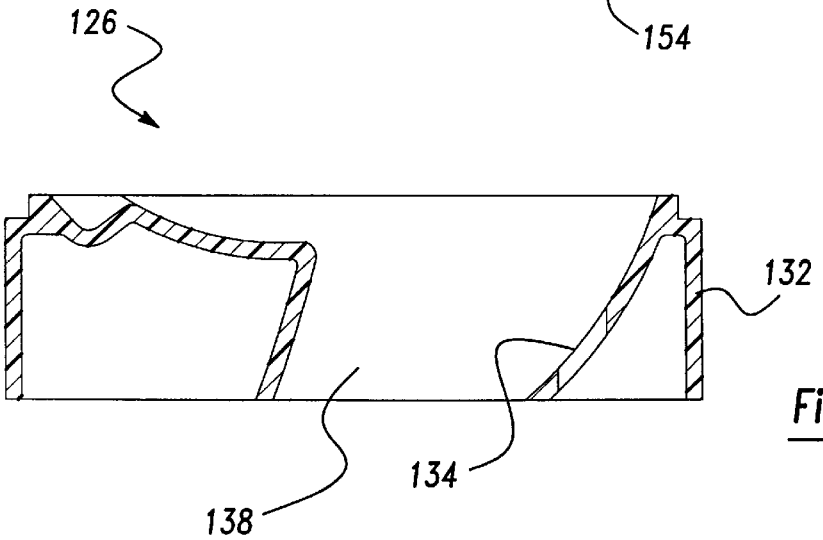
FIG. 9 is a vertical sectional view of the floating disk shown in FIGS. 7 and 8.

Referring now to FIGS. 7–9, floating member 126 is illustrated. Floating member 126 includes outer cylindrical surface 132, contoured or cam surface 134, straw aperture 136 and central aperture 138 as detailed above. Cam surface 134 defines a first contoured surface 150 and a second contoured surface 152. Contoured surfaces 150 and 152 form a bi-directional cam surface which will rotate floating member 126 clockwise or counterclockwise depending on whether contoured surface 150 or contoured surface 152 is engaged by closure tab 122 (FIG. 5). The incorporation of contoured surface 150 and contoured surface 152 limits the maximum amount of rotation of floating member 126 to 180° in order to align straw 130 with orifice 120 (FIG. 5). A ridge 154 separates contoured surface 150 from contoured surface 152 at one end while the opposite ends of surfaces 150 and 152 blend together as shown in the drawings.

During the opening of beverage can 110 closure tab 122 engages either contoured surface 150 or 152 to impart rotational movement to floating member 126, buoyant member 128 and straw 130. In order to ensure rotational movement of floating member 126 and to avoid excessive tipping of floating member 126, straw 130 and buoyant member 128 may act as a torque arm to stabilize floating member 126 and limit the amount of its tipping. As detailed above, the diameter of buoyant member 128 is chosen such that when the outer circumferential edge of buoyant member 128 is in contact with the inside wall of can body 112, straw 130 is positioned generally vertically within beverage can 110. Any tilting of floating member 126 will be resisted by straw 130 and buoyant member 128 acting between the sidewall of can body 112 and the interior surface of aperture 136 of floating member 126. The use of straw 130 and buoyant member 128 as a torque arm allows for the shortening of the overall height of cylindrical surface 132 of floating member 126.

Figure 10:
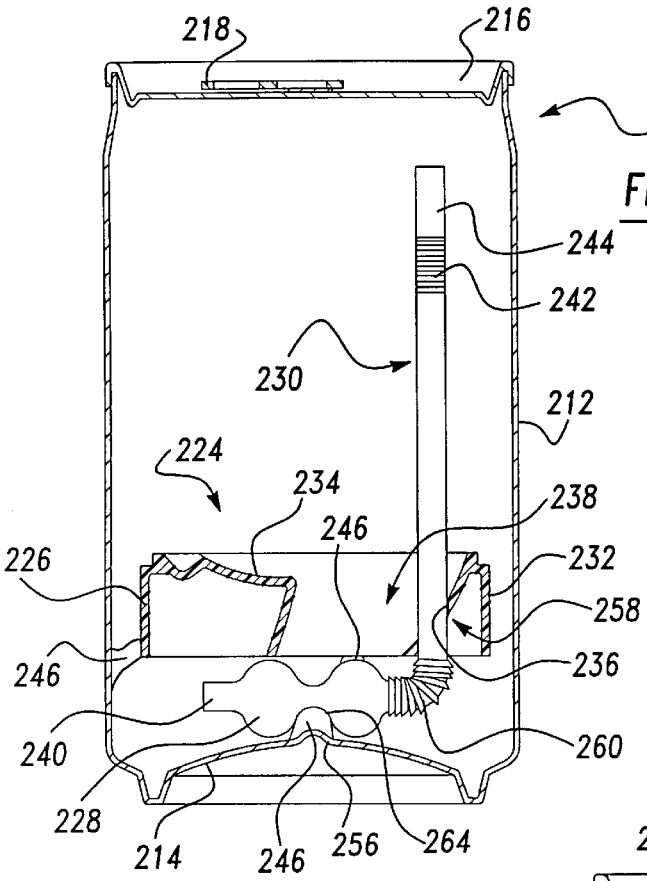
FIG. 10 is a vertical sectional view of a beverage can containing a straw-dispensing mechanism according to a third embodiment of the present invention.
Figure 11:
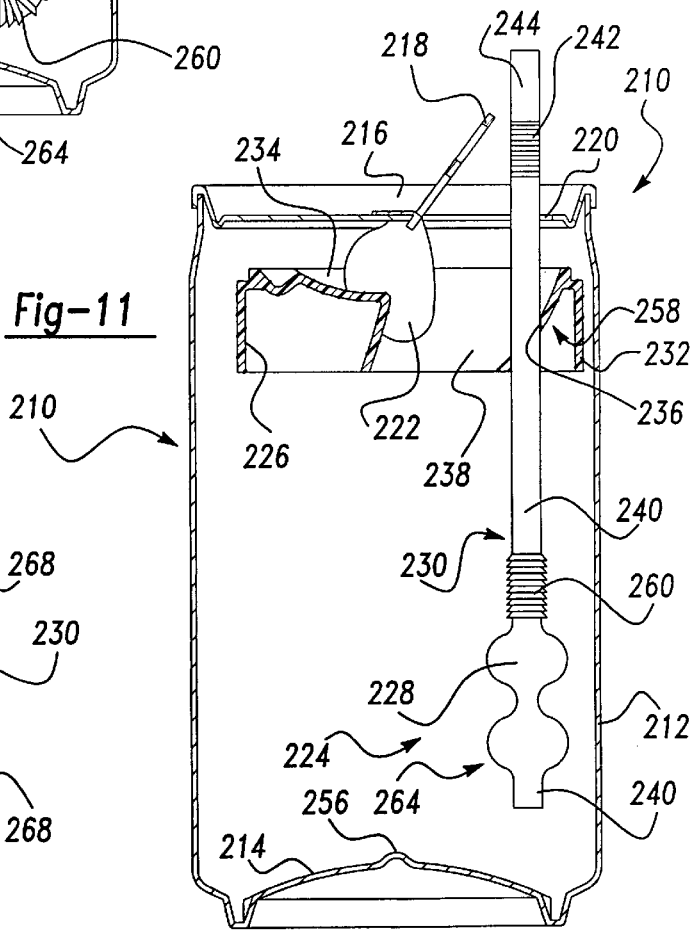
FIG. 11 is a vertical sectional view of the beverage can shown in FIG. 10 illustrating the operation of a buoyant member.

Referring now to FIGS. 10 and 11, there is shown a beverage can having a straw dispensing mechanism in accordance with a third embodiment of the present invention which is designated generally by reference numeral 210. Beverage can 210 comprises an aluminum, steel or plastic container having a cylindrical body 212 with a closed bottom 214 and an upper lid 216. The closed bottom 214 of beverage can 210 is arched upwardly to a greater degree than conventional beverage cans to form a nub 256. Lid 216 is joined to body 212 using a seaming process as is well known in the art. Lid 216 includes an actuating member or lever ring 218 pivotally secured to lid 216. Lever ring 218 is adapted when actuated to open an orifice 220 in lid 216 by deflecting a closure tab 222 into the interior of beverage can 210. Closure tab 222 is formed by score lines in lid 216 which enable a controlled portion of closure tab 222 to break free from lid 216 when lever ring 218 is actuated against tab 222 by a user. As a user lifts one end of ring 218, the opposite end pushes against closure tab 222. Alternatively, the tab 222 could be designed to break free when depressed by the user's finger or by the use of a portable tool. In these types of closure tabs, lever ring 218 may be omitted. Closure tab 222 is typically designed via the score lines to deflect downwardly and towards one side of orifice 220 to fully open orifice 220 and facilitate the free flow of liquid from beverage can 210 through orifice 220.

Beverage can 210 further comprises a straw dispensing mechanism 224 which is comprised of a floating member 226, a buoyant member 228 and a drinking straw 230. Floating member 226 defines an outer cylindrical surface 232, a contoured or cam surface 234 and a straw aperture 236. Straw aperture 236 includes a radiused or flared entrance end 258 for facilitating entry of drinking straw 230 therethrough.

Floating member 226 is manufactured from a material which will float within the liquid contained inside beverage can 210 and thus will position itself adjacent to lid 216 in a filled beverage can 210. Outer cylindrical surface 232 of floating member 226 is sized slightly smaller than the internal diameter of can body 212. Thus, floating member 226 is free to move axially within beverage can 210 and will be urged against lid 216 due to the buoyant force acting on floating member 226. The height of surface 232 is chosen to work in conjunction with straw 230 to limit the tilting of floating member 226 in order to maintain straw 230 in a generally vertical position as shown in the drawings. Aperture 236 extends vertically through floating member 226. The radial positioning of aperture 236 positions aperture 236 in direct vertical alignment with orifice 220 when aperture 236 is circumferentially aligned with orifice 220. Centrally located aperture 238 allows for filling the volume of beverage can 210 located below floating member 226. Alternatively, additional passages through floating member 226 or the clearance between floating member 226 and the interior of can body 212 may be used to facilitate the filling of beverage can 210.

Figure 10A:
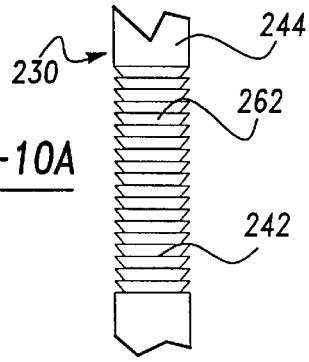
FIG. 10*a* is a schematic view of the pull-out flexible convoluted section of the straw shown in FIG. 10.

Drinking straw 230 includes a lower tubular portion 240, a buoyant member 228, a bendable flexible convoluted section 260, a pull-out flexible convoluted section 242 and an upper tubular portion 244. Upper tubular portion 244 of drinking straw 230 extends through aperture 236 in floating member 226. Aperture 236 is slightly larger than upper tubular portion 244 and thus slidingly receives upper tubular portion 244. As illustrated in FIG. 10*a*, pleats 262 constituting pull-out flexible convoluted section 242 are internally fluted so as to maintain a constant maximum diameter of drinking straw 230. Pleats 262 are also angled downwardly to facilitate the rise of floating member 226 over the pull-out flexible convoluted section 242. Thus, floating member 226 is free to move vertically within beverage can 210 with respect to straw 230.

Buoyant member 228 is formed integrally with the lower end of lower tubular portion 240 to urge straw 230 in an upward direction. The configuration of buoyant member 228 is chosen such that a knuckle 264 is provided for cooperating with the nub 256 of the bottom 214 of the beverage can 210. The bendable flexible convoluted section 260 enables the lower tubular portion 240 of the drinking straw 230 to be positioned orthogonal to the upper tubular portion 244 and adjacent to bottom 214.

FIG. 10 illustrates beverage can 210 and straw dispensing mechanism 224 immediately after the filling and seaming operation have been performed. Drinking straw 230 extends from bottom 214 of can body 212 vertically upward through aperture 236 of floating member 226 towards lid 216. The circumferential positioning of straw 230 in relation to orifice 220 occurs randomly due to the filling and seaming processes for beverage can 210. To prevent floating member 226, and straw 230 from elevating during the can filling and seaming processes, and thus possibly interfering with these processes, a small amount of soluble adhesive 246, such as glucose or thixotropic gel is preferably applied to temporarily bond buoyant member 228 to can bottom 214.

Accordingly, after the filling and seaming processes are complete, adhesive 246 will gradually dissolve and thereby enable floating member 226 to float upwardly to be urged against lid 216 and enable buoyant member 228 and straw 230 to float freely upward until straw 230 contacts lid 216. Bendable flexible convoluted section 260 straightens out under its own residual internal stresses once the floating member 226 floats upwardly. Additionally, the water soluble adhesive 246 may also be placed in aperture 236 in floating member 226 to fix the straw 230 and floating member 226 relative to one another. This position is selected such that the center of the buoyant member 228 comprising knuckle 264 aligns with the center of floating member 226. Alternatively, the buoyant member 228 may be secured to bottom 214 by mechanical means such as frictional engagement of knuckle 264 with nub 256.

Optionally, the buoyant member 228 may be temporarily adhered to the floating member 226 through use of a small amount of soluble adhesive 246. Locating contours may be molded into the bottom surface of the floating member 226 to properly seat the buoyant member 228 thereon. If desired, two soluble adhesive 246 compositions may be used to sequentially time release the straw 230 from the bottom 214 of the beverage can 210 and/or the straw 230 from the floating member 226.

FIG. 11 illustrates beverage can 210 and straw dispensing mechanism 224 after lever ring 218 has pushed closure tab 222 into the interior of beverage can 210 to open orifice 220. The deflection of closure tab 222 from its closed (generally horizontal) position as shown in FIG. 10 to its open (generally vertical) position as shown in FIG. 11 results in engagement between closure tab 222 and floating member 226 which imparts rotational movement to floating member 226, and straw 230. Floating member 226 will rotate until straw 230 is aligned with open orifice 220. When straw 230 is aligned with orifice 220, buoyant member 228 will push straw 230 upward through orifice 220 to provide accessibility to straw 230 by the user of beverage can 210.

At this point, the user may elect commence drinking through straw 230 or withdraw straw 230 from its orifice 220 in lid 216. Buoyant member 228 is formed with sufficient flexibility such that when straw 230 is pulled upward, straw 230 and buoyant member 228 may pass through floating member 226. Convoluted section 242 can be extended regardless of whether or not straw 230 extends through aperture 236, to allow the user to reach fully to bottom 214 of beverage can 210.

Figure 12:
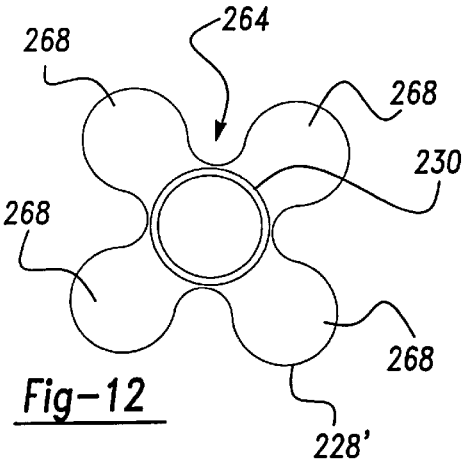
FIG. 12 is a vertical sectional view of an alternate embodiment buoyant member for use in conjunction with the straw-dispensing mechanism shown in FIGS. 10 and 11.

Referring now to FIG. 12, an alternate embodiment buoyant member 228' is illustrated. In this case, buoyant member 228' is formed as a discrete member adapted to be supported about the external radial surface of straw 230 by adhesive or the like. Although four distinct lobes 268 are illustrated 90° apart about the diameter of straw 230, other angular displacements and numbers of lobes are possible. The spacing between consecutive lobes 268 define the knuckle 264.

Figure 13:
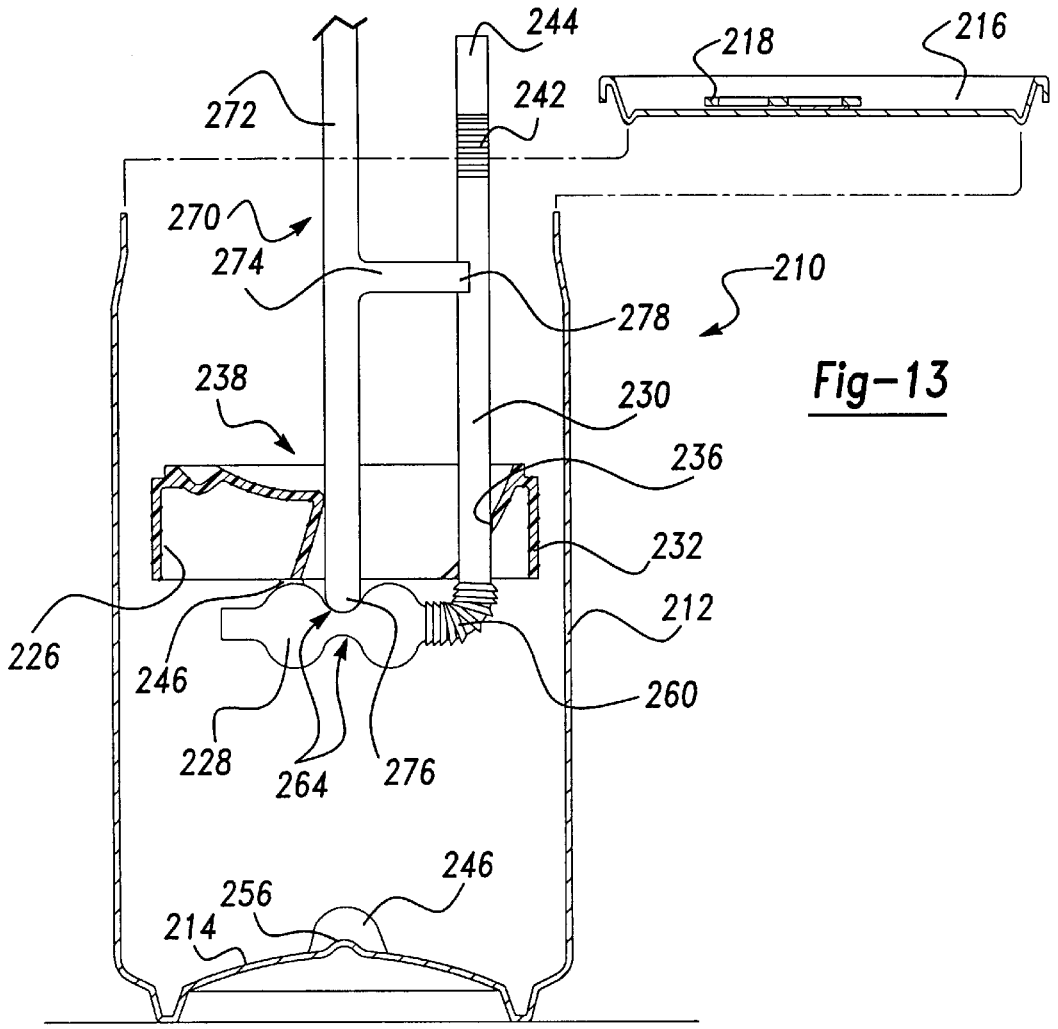
FIG. 13 is a vertical sectional view of the beverage can shown in FIGS. 10 and 11 illustrating an insertion mechanism according to the present invention.

Referring to FIG. 13, an insertion device 270 is illustrated. Insertion device 270 includes a vertical member 272 coupled to a horizontal member 274. The distal end 276 of the vertical member 272 is adapted to engage knuckle 264 on buoyant member 228. A distal end 278 of horizontal member 274 is adapted to releasably engage upper tubular portion 244 of drinking straw 230. In operation, the insertion device 270 lowers the drinking straw 230 into the beverage can 210. After the buoyant member 228 contacts the bottom 214 of the beverage can 210, a follower (not shown) presses the knuckle 264 of the buoyant member 228 onto the nub 256. Soluble adhesive 246 may be utilized to fix buoyant member 228 to nub 256 at this point. Thereafter, the vertical member 272 and horizontal member 274 release from the drinking straw 230 and the insertion device 270 withdraws from the beverage can 210. Preferably, the insertion device 270 is cam driven and pneumatically operated to effect high speed insertion.

After insertion of the straw 230, the beverage can 210 is closed with lid 216 by a conventional seaming process. As the soluble adhesive 246 between buoyant member 228 and floating member 226 dissolves, the floating member 226 will rise along the straw 230 by its own buoyancy. At some point prior to reaching the lid 216, sufficient torque is applied to the knuckle 264 such that the buoyant member 228 is removed from the nub 256. Thereafter, the bendable flexible convoluted section 260 straightens under its own internal stresses. From this point, the straw 230 acts in the above-described manner, activated by the cam surface 234 as described with reference to FIGS. 7–9.

Alternatively, the length of the straw 230 may be controlled such that it is long enough to reach the full extent of the beverage can 210. As such, the straw 230 holds the floating member 226 when it rises vertically. When the closure tab 222 imparts rotational movement to floating member 226, straw 230 moves about the nub 256 and loosens its attachment thereto. The combined forces permits the straw 230 to rise off the bottom 214 of the beverage can 210 and assume its fully extended posture.

Figure 14:
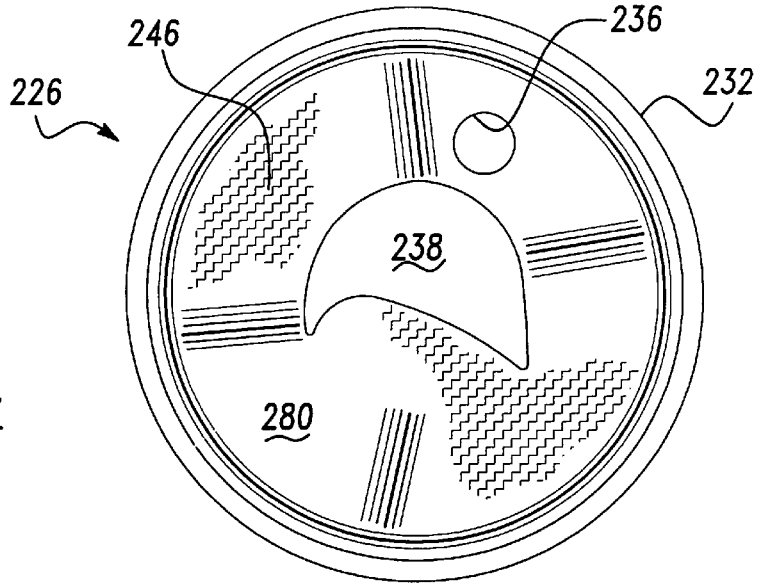
FIG. 14 is a bottom view of the floating disk of FIGS. 10, 11 and 13 illustrating a fourth embodiment of the present invention.

Referring now also to FIG. 14, floating member 226 is illustrated to expose its bottom surface 280. Floating member 226 includes outer cylindrical surface 232, straw aperture 236 and central aperture 238 as detailed above. The bottom surface 280 of the floating member 226 has been treated with corona, flame, or by other conventional means to change the surface morphology and/or the surface energy thereof to facilitate the nucleation of $CO_2$ bubbles and to adhere these bubbles to the surface 280 in accordance with a fourth embodiment of the present invention. The treated surface 280 is covered by a soluble adhesive 246, such as glucose or thixotropic gel, to temporarily isolate or seal off surface 280 from the fluid in beverage can 210. Preferably, the soluble adhesive 246 comprises the syrup of the product to be housed by the beverage can 210. As such, the covered surface 280 does not accelerate nucleation of $CO_2$ during the filling process. After filling and seaming, the acid nature of the product housed by beverage can 210 will dissolve the soluble adhesive coating 246 revealing the nucleation surface.

After the closure tab 222 (FIG. 11) is opened, and the internal pressure within beverage can 210 is released, the nucleating surface 280 on the underside of the floating member 226 accumulates nucleated bubbles. This enhances the buoyancy of the floating member 226 and holds the floating member 226 more firmly against the lid 216 during the rotation of the floating member 226 and raising of straw 230. The vertical pressure of the floating member 226 against the lid 216 enhances the accuracy and precision of the alignment of straw 230. The vertical pressure also minimizes the tilting of floating member 226 when engaged by tab 222.

Figure 15:
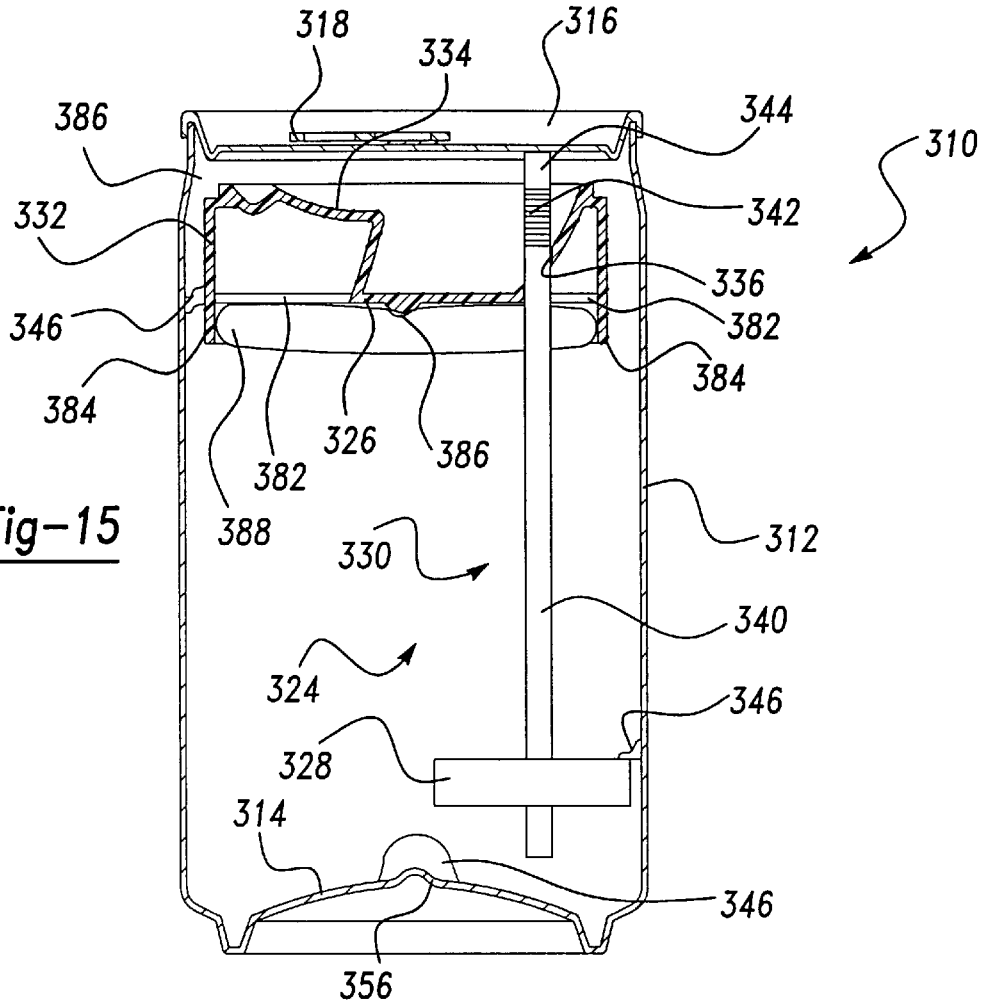
FIG. 15 is a vertical sectional view of a beverage can containing a straw-dispensing mechanism according to a fifth embodiment of the present invention.
Figure 16:
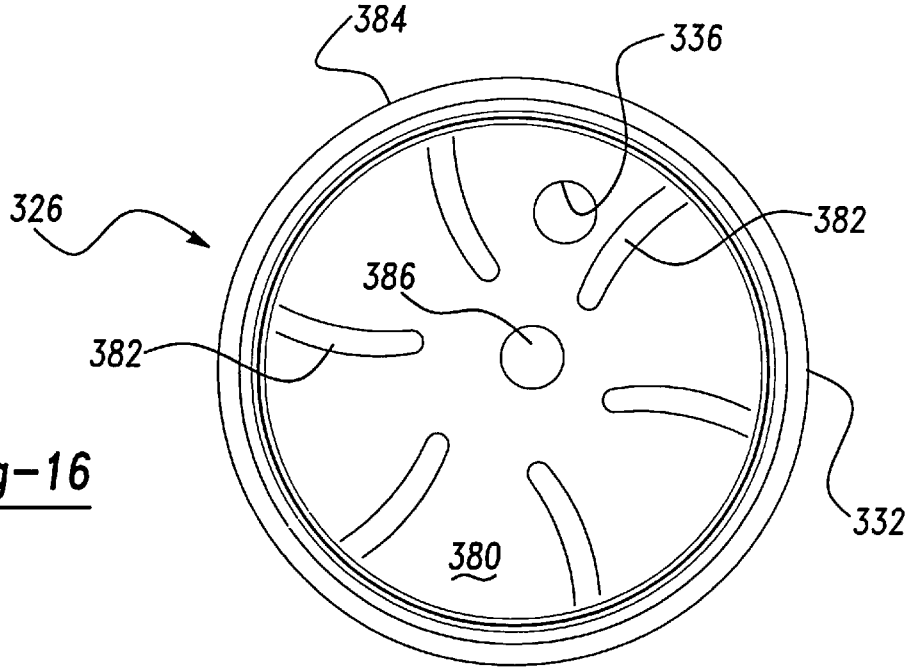
FIG. 16 is a bottom view of the floating disk of FIG. 15.

Referring now to FIGS. 15–16, there is shown a beverage can 310 having a straw dispensing mechanism in accordance with a fifth embodiment of the present invention. Straw dispensing mechanism 324 comprises a floating member 326, a buoyant member 328 and a drinking straw 330.

Floating member 326 defines an outer cylindrical surface 332, a contoured or cam surface 334 and a straw aperture 336. Floating member 326 is manufactured from a material which will float within the liquid contained inside beverage can 310 and will thus position itself adjacent to lid 316 in a filled beverage can 310. Preferably, a high speed injection molding process is utilized to form a thin walled floating member 326. Outer cylindrical surface 332 of floating member 326 is sized slightly smaller than the internal diameter of can body 312. Thus, floating member 326 is free to move axially within beverage can 310 and will be urged against lid 316 due to the buoyant force acting on floating member 326. In order to further urge floating member 326 against lid 316, a specialized topography is utilized on the underside 380 of the floating member 326. The underside includes a plurality of radially projecting spiral flutes 382. The underside 380 also includes a downwardly projecting skirt 384 about its outer cylindrical surface 332. Optionally, the underside 380 includes a projection 386 at the center which can be located onto pivot nub 356 on the bottom 314 of the beverage can 310 and held in place with a soluble adhesive 346. Alternatively, the underside 380 may be molded such that the surface is roughened or deliberately pocked to both nucleate and trap gas bubbles under floating member 326.

During filling of the beverage can 310 in a conventional filling process, the turbulence of the fluid will wash the underside 380 of the floating member 326. The spiral flutes 382 enhance this action. The turbulence sweeps out any residual air space under the floating member 326 to minimize the loss of fill volume in the beverage can 310 due to the presence of the floating member 326. However, some residual gas will remain entrapped under floating member 326. The buoyancy of the floating member 326 and any residual gas is opposed by the adherence of the soluble material 346.

After the beverage can 310 is filled, it is closed with lid 316 by a conventional seaming process. Thereafter, the filled beverage can 310 is inverted by means of track work (not shown). As such, the unfilled headspace 386 in the beverage can 310 resides adjacent the bottom 314. This head space 386 displaces any fluid that may have remained proximate the underside of the floating member 326 during inversion. The beverage can 310 continues in an inverted orientation along the track work for a distance and/or time to ensure that all of the fluid is adjacent bottom 314 replaced with air. As the beverage can 310 continues along the track work, it is inverted again to place it in its original upright orientation. The head space 386 is then trapped along the underside 380 of the floating member 326 and forms a head space bubble 388 thereunder. The size of the head space 386 and the allocation of gas between the head space 386 adjacent lid 316 and the head space bubble 388 adjacent the underside 380 of the floating member 326 is preferably balanced in accordance with the needs of the beverage can 310.

Subsequent to the head space bubble 388 being trapped under the floating member 326, the floating member 326 is released from the bottom 314 of the beverage can 310 and the floating member 326 rises towards the lid 316 for presenting the drinking straw 330. The trapped head space bubble 388 on the underside 380 of the floating member 326 enhances the buoyancy of the floating member 326. Further, the head space bubble 388 holds the floating member 326 more tightly against the lid 316 during rotation of the floating member 326 by the closure tab 322. This vertical pressure of the floating member 326 against the underside of the lid 316 enhances the accuracy and precision of the placement of straw 330.

Figure 17:
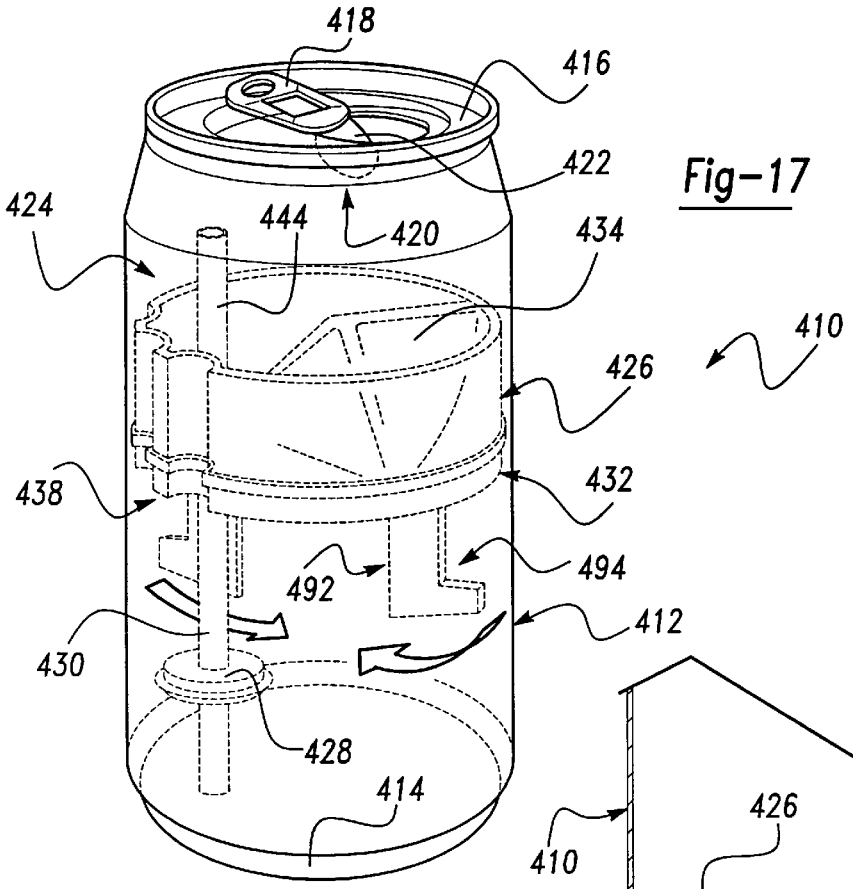
FIG. 17 is a perspective view of a beverage can containing a straw-dispensing mechanism according to a sixth embodiment of the present invention.
Figure 18:
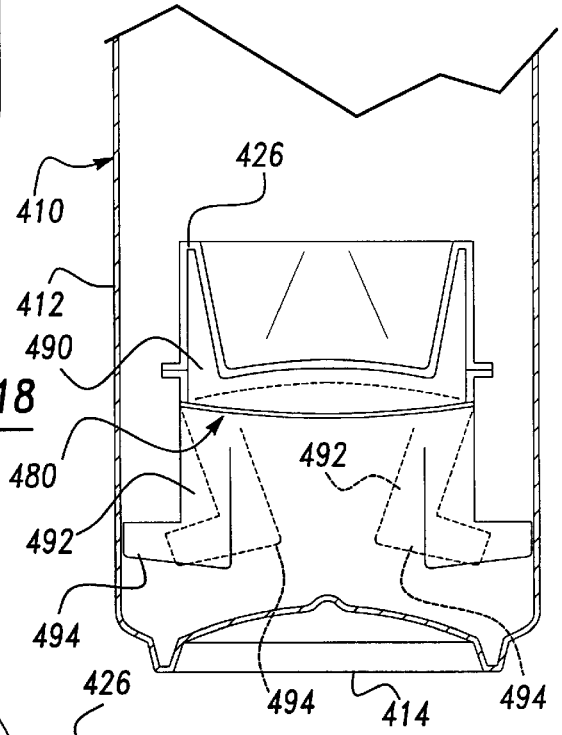
FIG. 18 is a vertical sectional view of the straw-dispensing mechanism shown in FIG. 17 illustrating the disengagement of associated leg assemblies.
Figure 19:
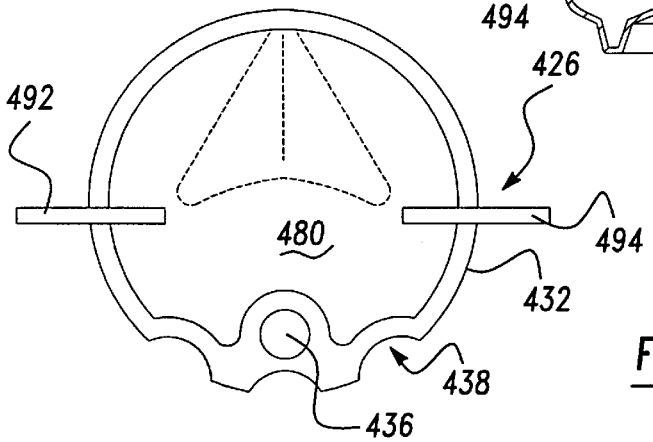
FIG. 19 is a bottom view of the floating disk shown in FIGS. 17 and 18.

Referring now to FIGS. 17–19, there is showing a beverage can having a straw dispensing mechanism in accordance with a sixth embodiment of the present invention designated generally by reference numeral 410. The beverage can 410 includes a straw dispensing mechanism 424 which is comprised of a floating member 426, a buoyant member 428 and a drinking straw 430. Floating member 426 defines an outer cylindrical surface 432, a contoured or cam surface 434 and a straw aperture 436. Floating member 426 is manufactured from a material which will float within the liquid contained inside beverage can 410 and thus will position itself adjacent to lid 416 in a filled beverage can 410. Outer cylindrical surface 432 of floating member 426 is sized slightly smaller than the internal diameter of can body 412. Thus, floating member 426 is free to move axially within beverage can 410 and will be urged against lid 416 due to the buoyant force acting on floating member 426. Aperture 436 extends vertically through floating member 426. The radial positioning of aperture 436 positions aperture 436 in direct vertical alignment with orifice 420 when aperture 436 is circumferentially aligned with orifice 420. A centrally located aperture (not shown) may be provided for filling of the volume of beverage can 410 located below floating member 426. However, it is presently preferred to utilize the passages 438 along outer cylindrical surface 432 of floating member 426 and clearance between the floating member 426 and the interior of can body 412 to facilitate the filling of beverage can 410.

Floating member 426 is manufactured such that an internal volume thereof includes a fixed volume airspace 490. Because the floating member 426 is hermetically sealed, the pressure in the interior volume 490 is constant. Floating member 426 also includes at least two downwardly projecting leg assemblies 492 including foot portions 494 extending laterally therefrom. The bottom surface 480 of the floating member 426 is preferably outwardly dome shaped such that the foot portions 494 are radially extended to engage the interior of can body 412. As such, the floating member 426 is frictionally held adjacent the bottom 414 of the beverage can 410. Further, the bottom surface 480 of the floating member 426 engages the upper side of the buoyant member 428. In this mode, the floating member 426 maintains the straw 430 in a pre-selected position such that the upper tubular portion 444 thereof does not extend beyond the top of can body 412 so that it will not interfere with the placement of the lid 416 on the body 412 during the seaming process.

After the filling and seaming processes are complete the fluid contained within the beverage can releases $CO_2$ increasing the pressure within beverage can 410. However, since the pressure within the air space 490 is fixed, a pressure difference between the internal volume 490 of the floating member 426 and the interior volume of the beverage can 410 is realized. When this pressure difference exceeds a predetermined threshold, the bottom surface 480 of the floating member 426 collapses inwardly to invert its dome-like shape. Accordingly, the leg assemblies 492 are drawn inwardly away from the interior of can body 412. Thus, foot portions 494 disengage from can body 412 and floating member 426 is released and may float towards lid 416 along straw 430.

The circumferential positioning of straw 430 in relation to orifice 420 occurs randomly within beverage can 410. The deflection of closure tab 422 from its closed (generally horizontal) position to its open (generally vertical) position results in engagement between closure tab 422 and floating member 426 which imparts rotational movement to floating member 426, buoyant member 428 and straw 430. Floating member 426 will rotate until straw 430 is aligned with open orifice 420. When straw 430 is aligned with orifice 420, buoyant member 428 will push straw 430 upward through orifice 420 to provide accessibility to straw 430 by the user of beverage can 410.

Figure 20:
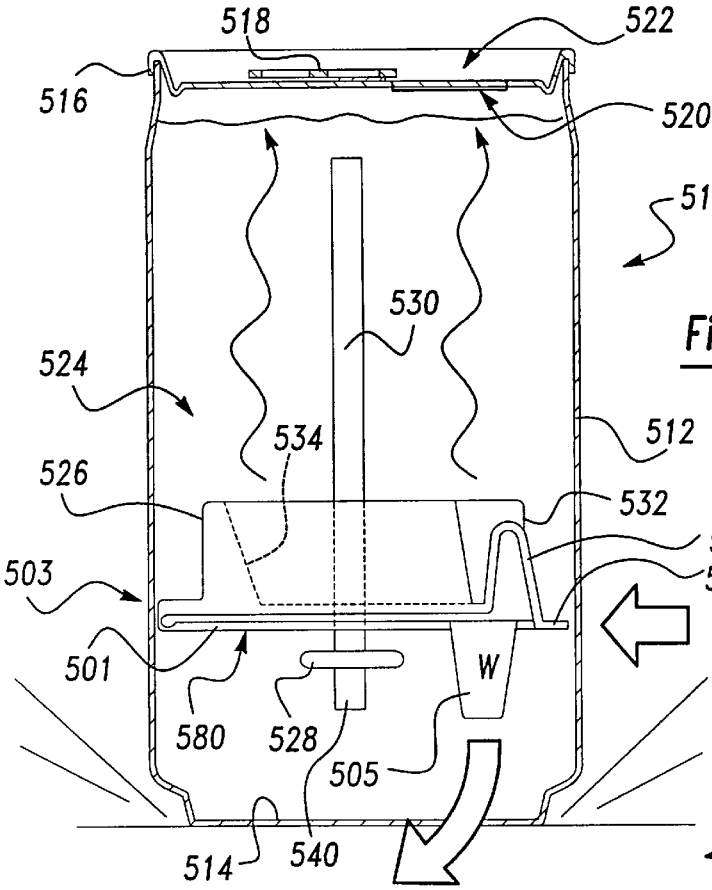
FIG. 20 is a vertical sectional view of a beverage can containing a straw-dispensing mechanism according to a seventh embodiment of the present invention.
Figure 21:
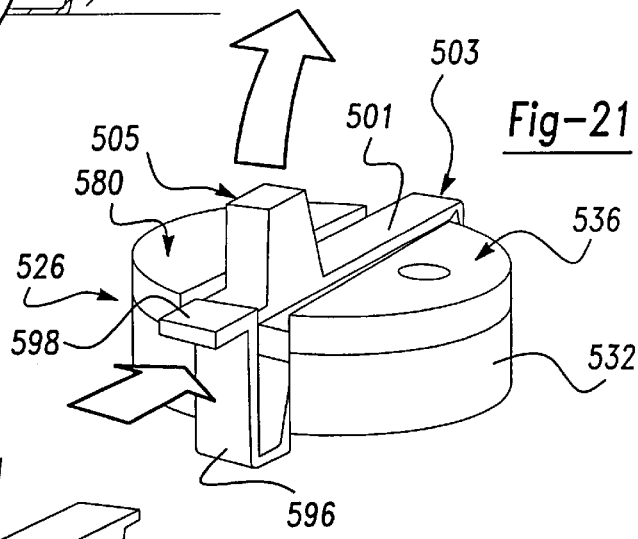
FIG. 21 is a perspective view of the floating disk shown in FIG. 20 in a closed mode.
Figure 22:
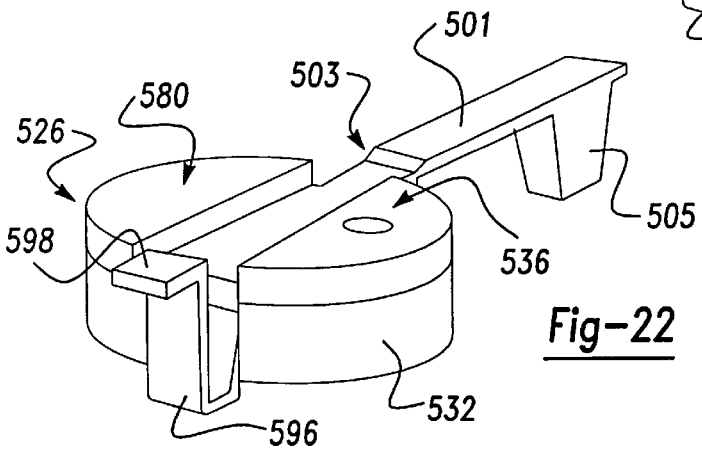
FIG. 22 is a perspective view of the floating disk shown in FIGS. 20 and 21 in an open mode.

Referring now to FIGS. 20–22, there is shown a beverage can having a straw dispensing mechanism in accordance with a seventh embodiment of the present invention which is designated generally by reference number 510. Beverage can 510 includes straw dispensing mechanism 524 which is comprised of a floating member 526, a buoyant member 528 and a drinking straw 530. Floating member 526 defines an outer cylindrical surface 532, a contoured or cam surface 534 and a straw aperture 536.

An upwardly projecting U-shaped latch 596 is coupled to or may be integrally formed with outer cylindrical surface 532. Latch 596 includes a radially projecting finger 598 extending therefrom. The latch 596 is biassed such that the finger 598 is normally drawn towards the center of floating member 526. An arm 501 is coupled to or integrally formed with outer cylindrical surface 532 of floating member 526 opposite latch 596 by a living hinge 503. In FIGS. 20 and 21, the arm 501 is folded against the bias of hinge 503 to rest adjacent the underside 580 of floating member 526. Arm 501 is held in this position by the frictional engagement with latch 596 opposite finger 598. Arm 501 includes a tab 505 outwardly projecting therefrom which, in cooperation with living hinge 503, encourages arm 501 away from the underside 580 of floating member 526. The diameter between the outer radial surface of living hinge 503 and the outermost edge of finger 598 is such that, when the arm 501 is folded under floating member 526 and engages living hinge 503, finger 598 and living hinge 503 frictionally engage the interior of can body 512. As such, floating member 526 may be temporarily held in place within the interior of beverage can 510 during the filling and seaming processes.

After the filling and seaming processes are complete a sudden force to beverage can 510 frees arm 501 from latch 596. At this point, arm 501 rotates under the bias of living hinge 503 and with the assistance of tab 505 away from floating member 526. Preferably, the tab 505 will strike the bottom 514 of can 510 to provide an initial thrust towards lid 516. After arm 501 disengages, the bias of latch 596 functions to draw finger 598 radially inwardly from the interior of can body 512 and reduces the dimension between the outer radial surface of the living hinge 503 and the outermost edge of finger 598. As such, floating member 526 disengages from the interior of can body 512 and is free to migrate towards lid 516.

Floating member 526 is manufactured from a material which will float within the liquid contained inside beverage can 510 and thus will position itself adjacent to lid 516 in a filled beverage can 510. Floating member 526 is urged against lid 516 due to the buoyant force acting on floating member 526. Aperture 536 is slightly larger than lower tubular portion 540 of straw 530 and thus, floating member 526 is free to move vertically within beverage can 510 with respect to straw 530. Buoyant member 528 is attached to the lower end of lower tubular portion 540 to urge straw 530 in an upward direction.

Figure 23:
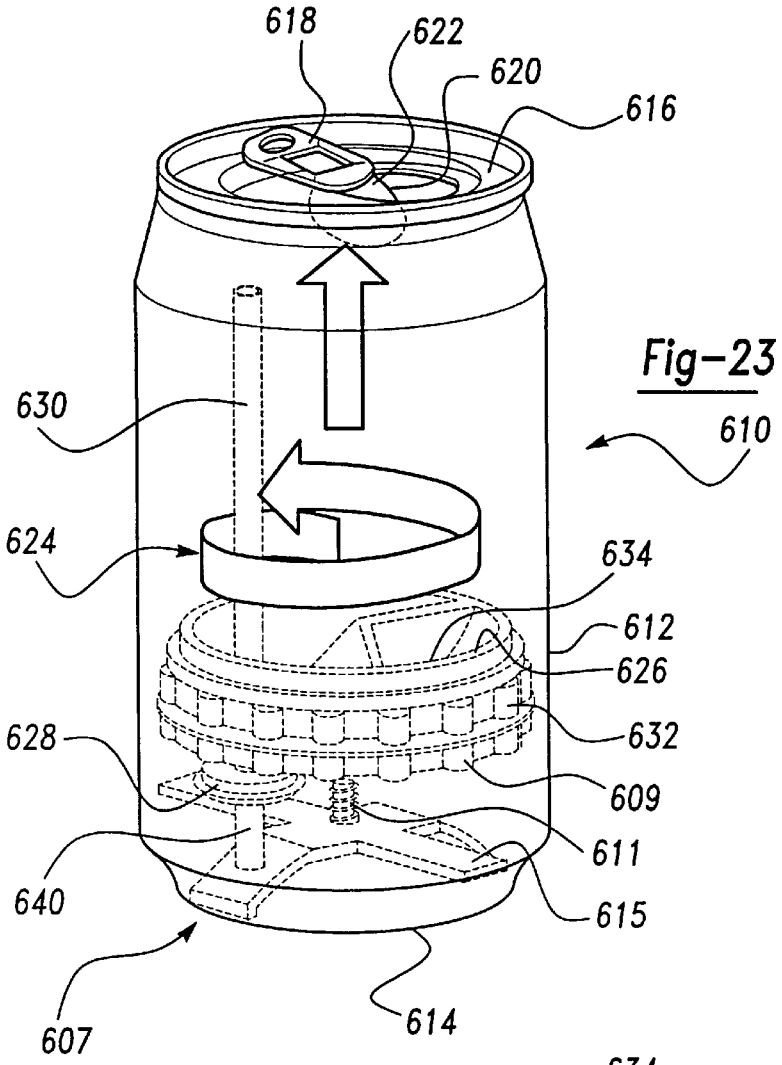
FIG. 23 is a perspective view of a beverage can containing a straw dispensing mechanism according to an eighth embodiment of the present invention.
Figure 24:
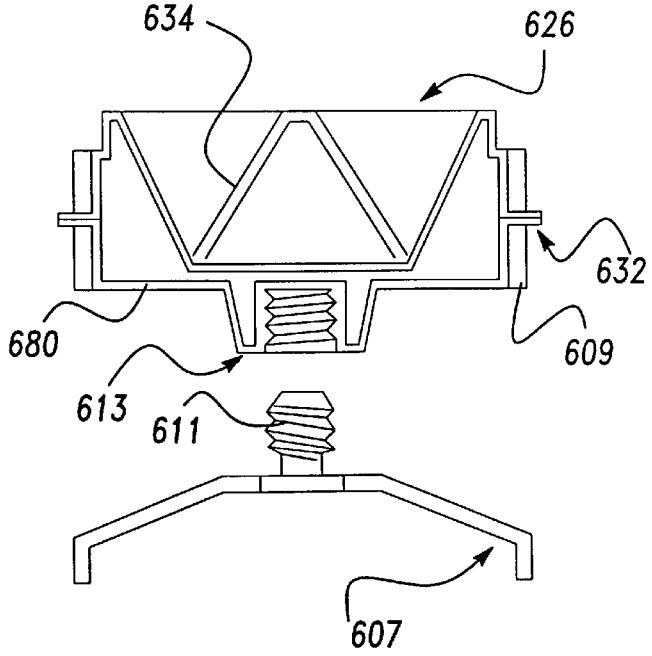
FIG. 24 is a vertical sectional view of the floating disk and base shown in FIG. 23.

Referring now to FIGS. 23 and 24, there is shown a beverage can having a straw dispensing mechanism in accordance with an eighth embodiment of the present invention which is designated generally by reference number 610. Beverage can 610 includes a straw dispensing mechanism 624 which is comprised of a base member 607, a floating member 626, a buoyant member 628 and a drinking straw 630. Floating member 626 defines an outer cylindrical surface 632, a contoured or cam surface 634 and a straw aperture (not shown). A plurality of dams 609 radially project about a perimeter of outer cylindrical surface 632.

Base 607 is coupled to the bottom 614 of beverage can 610 by adhesive or other conventional means and includes a threaded member 611 vertically projecting therefrom. Preferably, threaded member 611 is aligned with a center of the bottom 614 of beverage can 610. The underside 680 of floating member 626 includes a threaded aperture 613 formed therein complimentary of threaded member 611. The height of threaded member 611 is selected such that a sufficient clearance is defined between the underside 680 of floating member 626 and upper surface of base 607 to accommodate the lower tubular portion 640 of drinking straw 630 and buoyant member 628. It should be noted that although base 607 is illustrated as including a plurality of outwardly projecting supports 615, some of which engage the bottom 614 of can 610 and others of which engage the interior of can body 612, this configuration is merely exemplary of the number of configurations suitable for this purpose. However, the supports 615 are presently preferred since they minimize the amount of fluid displaced by base 607 within beverage can 610.

Prior to the filling and seaming processes, floating member 626 is removably secured to base 607 by threading engagement of threaded member 611 with threaded aperture 613. After the filling process and seaming processes the beverage can 610 typically undergoes rotation as it moves along conventional track work. During this time, the fluid contained inside beverage can 610 impinges upon and frictionally engages dams 609 causing floating member 626 to rotate relative to base 607. This rotation backs the threaded aperture 613 off of the threaded member 611. After a number of rotations are complete, floating member 626 is released from base 607 by the disengagement of threaded aperture 613 from threaded member 611. Thus, floating member 626 is free to move axially within beverage can 610 and will be urged against lid 616 due to the buoyant force acting on floating member 626.

The straw aperture in floating member 626 is slightly larger than lower tubular portion 640 of straw 630 and thus floating member 626 is free to move vertically within beverage can 610 with respect to straw 630. Buoyant member 628 attached to the lower end of lower tubular portion 640 urges straw 630 in an upward direction.

Figure 25:
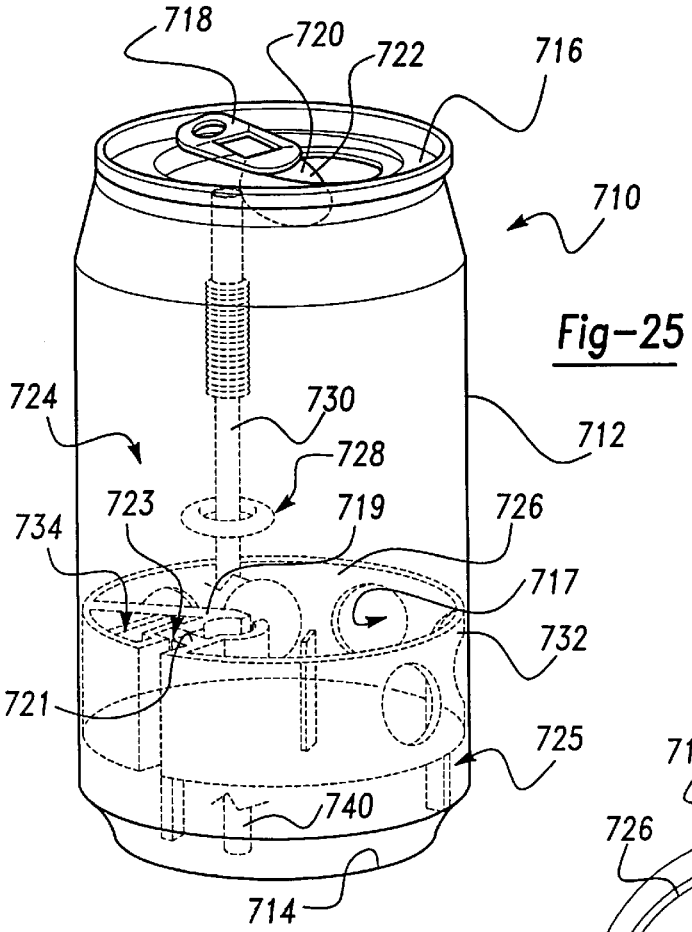
FIG. 25 is a perspective view of a beverage can containing a straw dispensing mechanism according to a ninth embodiment of the present invention.
Figure 26:
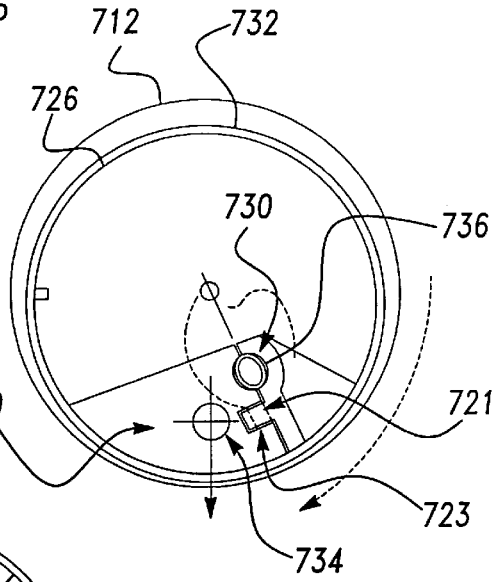
FIG. 26 is a plan view of the straw positioning member shown in FIG. 25 in a closed mode.
Figure 27:
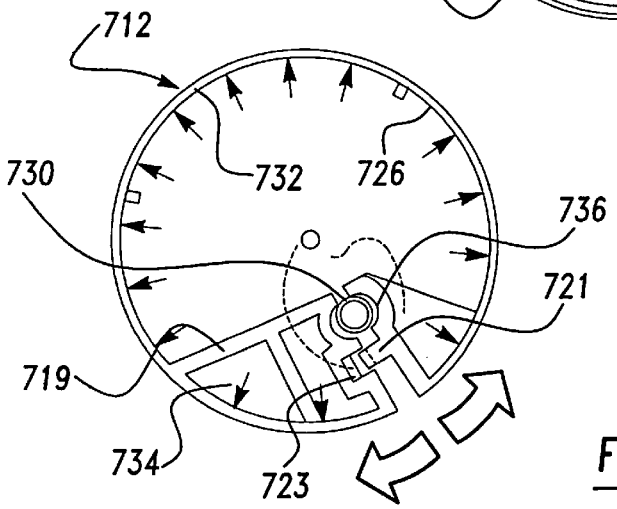
FIG. 27 is a plan view of the straw positioning member shown in FIGS. 25 and 26 in an open mode.

Referring now to FIGS. 25–27, there is shown a beverage can having a straw dispensing mechanism in accordance with a ninth embodiment of the present invention which is designated generally by reference numeral 710. Beverage can 710 further comprises a straw dispensing mechanism 724 which is comprised of a straw position fixing member 726, a buoyant member 728 and a drinking straw 730. Position fixing member 726 defines an outer cylindrical surface 732, an alignment member 734 and a straw aperture 736. Outer cylindrical surface 732 includes a plurality of apertures formed therein to reduce the volume of fluid displaced by positioning member 726.

Alignment member 734 is bifurcated along an interface defining an inertia latch through straw aperture 736. Inertia latch includes a boss 721 adapted to frictionally engage a slot 723. When the inertia latch is closed, the outer cylindrical surface 732 of positioning member 726 is sized slightly smaller than the internal diameter of can body 712.

Thus, positioning member 726 is free to move axially within beverage can 710. Also, aperture 736 is slightly smaller than lower tubular portion 740 of drinking straw 730 when inertia latch is closed. Thus, positioning member 726 prevents straw 730 from moving vertically within beverage can 710 when in this mode.

Prior to the filling and seaming processes, positioning member 726 is inserted within can body 712 and rests adjacent bottom 714 on legs 725. After the filling and seaming processes are complete, the beverage can 710 is turned on its side through track work or other conventional means and has its orifice 720 aligned and held at a predetermined orientation. Thereafter, alignment member 734 works by gravity to position straw 730 circumferentially adjacent to orifice 720. At this point, the inertia latch 719 is activated such that boss 721 is freed from slot 723. Preferably, this is accomplished by sharply striking beverage can 710. The activation of inertia latch 719 causes alignment member 734 to adopt an open mode configuration which fixes the location of the straw 730 relative to can 710.

In this configuration, outer cylindrical surface 732 of positioning member 726 expands radially outwardly under its inherent bias and fictionally engages the interior of can body 712. Also, the inertia latch 719 frees drinking straw 730 from aperture 736 which is now slightly larger than lower tubular portion 740. Thereafter, drinking can 710 can be reoriented to an upright position enabling buoyant member 728 and straw 730 to float freely upward until straw 730 contacts lid 716. Due to the fixed position of position fixing member 726 and the circumferential engagement between drinking straw 730 and aperture 736, drinking straw 730 is now properly aligned with orifice 720 such that upon opening, straw 730 is pushed upward by buoyant member 728 through orifice 720 to provide accessibility to straw 730 by the user of beverage can 710.

While the above detailed description describes the preferred embodiment of the present invention, it should be understood that the present invention is susceptible to modification, variation and alteration without deviating from the scope and fair meaning of the subjoined claims.

What is claimed is:

1. A beverage container comprising:

a body with a closed bottom end and a top end;

a lid closing said top end of said body, said lid defining a normally closed orifice;

a floating member disposed within said body, said floating member being urged against said lid when a liquid is disposed within said container;

a straw associated with said floating member; and a buoyant member unitary with said straw, said buoyant member urging said straw into engagement with said lid, said buoyant member further comprising a formed contour for cooperating with said closed bottom end of said body to temporarily secure said straw to said body.

2. A beverage container comprising:

a body with a closed bottom end and a top end;

a lid closing said top end of said body, said lid defining a normally closed orifice;

a floating member disposed within said body, said floating member being urged against said lid when a liquid is disposed within said container;

a straw associated with said floating member; and a buoyant member unitary with said straw, said buoyant member urging said straw into engagement with said lid, said closed bottom end of said body being formed to define a contour for cooperating with said buoyant member to temporarily secure said straw to said body.

3. A beverage container comprising:

a body with a closed bottom end and a top end;

a lid closing said top end of said body, said lid defining a normally closed orifice;

a floating member disposed within said body, said floating member being urged against said lid when a liquid is disposed within said container;

a straw associated with said floating member;

means for temporarily securing said straw to said body; and a buoyant member unitary with said straw, said buoyant member urging said straw into engagement with said lid, said buoyant member being disposed orthogonally to said straw when said straw is temporarily secured to said body, said buoyant member migrating from said orthogonal position to a generally vertical position relative to said straw when said means for temporarily securing said straw releases said straw.

4. The beverage container according to claim 3 wherein, said buoyant member elevates said straw through said orifice when said straw is aligned with said orifice.

5. The beverage container according to claim 3 wherein, said buoyant member further comprises a formed contour for cooperating with said closed bottom end of said body to temporarily secure said straw to said body.

6. The beverage container according to claim 3 wherein, said floating member includes an aperture for engaging said straw.

7. The beverage container according to claim 6 wherein, said aperture includes a radiused entrance end for slidably receiving said straw therethrough.

8. The beverage container according to claim 3 wherein, said straw includes a flexible section.

9. The beverage container according to claim 8 wherein, said flexible section includes a plurality of inwardly oriented pleats.

10. A beverage container according to claim 8 wherein, said flexible section provides a bend in said straw for orthogonally positioning said buoyant member relative to a remainder of said straw.

11. The beverage container according to claim 3 further comprising means for temporarily securing said floating member to said buoyant member.

12. The beverage container according to claim 3 wherein, said closed bottom end of said body is formed to define a contour for cooperating with said buoyant member to temporarily secure said straw to said body.

13. The beverage container according to claim 3 further comprising means for temporarily securing said straw to said floating member.

14. The beverage container according to claim 3 wherein, said floating member includes contours therein for accommodating said straw.

* * * * *